US009163881B2

(12) United States Patent
Watanabe

(10) Patent No.: US 9,163,881 B2
(45) Date of Patent: Oct. 20, 2015

(54) HEAT EXCHANGER

(71) Applicant: KEIHIN THERMAL TECHNOLOGY CORPORATION, Oyama-shi (JP)

(72) Inventor: Sumitaka Watanabe, Oyama (JP)

(73) Assignee: Keihin Thermal Technology Corporation, Oyama-shi (JP)

( * ) Notice: Subject to any disclaimer, the term of this patent is extended or adjusted under 35 U.S.C. 154(b) by 437 days.

(21) Appl. No.: 13/664,828

(22) Filed: Oct. 31, 2012

(65) Prior Publication Data

US 2013/0105130 A1 May 2, 2013

(30) Foreign Application Priority Data

Nov. 2, 2011 (JP) ..... 2011-241141

(51) Int. Cl.
*F28F 9/02* (2006.01)
*F28D 1/053* (2006.01)
*F28D 7/06* (2006.01)

(52) U.S. Cl.
CPC ..... *F28D 1/05391* (2013.01); *F28F 9/0217* (2013.01); *F28F 9/0253* (2013.01); *F28F 2220/00* (2013.01); *F28F 2275/122* (2013.01)

(58) Field of Classification Search
CPC ... F28F 9/0217; F28F 9/0253; F28F 2220/00; F28F 2275/122; F28D 1/05391
USPC ..... 165/173, 175
See application file for complete search history.

(56) References Cited

U.S. PATENT DOCUMENTS

| | | | | |
|---|---|---|---|---|
| 5,236,042 | A * | 8/1993 | Kado | 165/149 |
| 5,501,271 | A * | 3/1996 | Wijkstrom | 165/173 |
| 5,836,384 | A * | 11/1998 | Wijkstrom et al. | 165/173 |
| 7,637,314 | B2 * | 12/2009 | Park et al. | 165/174 |
| 8,235,099 | B2 * | 8/2012 | Higashiyama | 165/174 |
| 2007/0158057 | A1 * | 7/2007 | Higashiyama | 165/174 |
| 2007/0215331 | A1 * | 9/2007 | Higashiyama et al. | 165/167 |
| 2012/0204595 | A1 * | 8/2012 | Tamaki et al. | 62/498 |

FOREIGN PATENT DOCUMENTS

JP 2009-097776 A 5/2009

* cited by examiner

*Primary Examiner* — Tho V Duong
(74) *Attorney, Agent, or Firm* — Locke Lord LLP

(57) ABSTRACT

Each of front and rear side walls of a first member of a tank main body of each header tank of an evaporator has protrusions provided at longitudinal opposite ends thereof and projecting outward in the vertical direction. Front and rear outward projecting walls of a third member are cut away at the longitudinal opposite ends. The third member has protrusions provided at the longitudinal opposite ends of each of the front and rear side walls. Each protrusion is overlappingly located on the inner side of the corresponding protrusion of the first member, and is brazed thereto. Each engagement claw of each end member has a first portion brazed to the outer surface of the corresponding protrusion of the first member, and a second portion bent inward in the front-rear direction such that it engages with the corresponding protrusion, and its distal end is located inward of the outer surface.

3 Claims, 12 Drawing Sheets

HEAT EXCHANGER

BACKGROUND OF THE INVENTION

The present invention relates to a heat exchanger which is suitably used as an evaporator of a car air conditioner, which is a refrigeration cycle to be mounted on an automobile, for example.

In this specification and appended claims, the downstream side (a direction represented by arrow X in the drawings) of an air flow through air-passing clearances between adjacent heat exchange tubes will be referred to as the "front," and the opposite side as the "rear." Further, the upper, lower, left-hand, and right-hand sides of FIG. 2 will be referred to as "upper," "lower," "left," and "right," respectively.

The present applicant has proposed a heat exchanger which is used as an evaporator and which satisfies the requirements for reduction in size and weight and higher performance (refer to Japanese Patent Application Laid-Open (kokai) No. 2009-97776). The heat exchanger includes a heat exchange core section including a plurality of heat exchange tubes disposed such that their longitudinal direction coincides with the vertical direction, and header tanks disposed on the upper and lower sides of the heat exchange core section such that their longitudinal direction coincides with the direction of the row (arrangement direction) of the heat exchange tubes. Each header tank is composed of a tank main body which is open at opposite ends thereof, and end members which are brazed to the opposite ends of the tank main body so as to close the openings at the opposite ends. The tank main body of each header tank is composed of a first member which forms a portion of the tank main body on the side toward the heat exchange core section and to which the heat exchange tubes are connected, a second member which forms the remaining portion of the tank main body, and a third member which is disposed between the first member and the second member and is brazed to these members and which has a partition portion for vertically dividing the interior of the header tank into two spaces. The first member and the second member have, at each of front and rear side edges thereof, vertical wall portions which partially overlap each other as viewed from the front side and which are provided such that each vertical wall portion of the second member is located on the inner side of the corresponding vertical wall portion of the first member with a gap formed therebetween. The third member has, at each of the front and rear side edges thereof, a vertical wall portion which is disposed in the gap between the corresponding vertical wall portions of the first and second members and is brazed to the vertical wall portions, and a horizontal wall portion which is provided at the distal end of the vertical portion and projects outward in the front-rear direction and to which the distal end of the corresponding vertical wall portion of the first member is brazed. Each of the end members of each header tank has engagement claws which project toward the longitudinal center of the header tank and which are brazed to the tank main body in a state in which the engagement claws are engaged with the tank main body.

In the heat exchanger disclosed in the above-mentioned publication, each header tank has two header sections which are juxtaposed in the air flow direction and whose longitudinal direction coincides with the longitudinal direction of the header tank. A heat exchange tube group composed of a plurality of heat exchange tubes disposed at intervals in the longitudinal direction of the header tank is provided between each of the header sections of the upper header tank and a corresponding one of the header sections of the lower header tank. Upper end portions of the heat exchange tubes of the heat exchange tube groups are connected to the corresponding header sections of the upper header tank, and lower end portions of the heat exchange tubes of the heat exchange tube groups are connected to the corresponding header sections of the lower header tank. Each header section is formed by brazing caps to opposite ends of a tubular body which is open at the opposite ends, to thereby close the openings at the opposite ends of the tubular body. A refrigerant inlet is provided in one of the caps of the leeward header section of the upper header tank, and a refrigerant outlet is provided in the cap of the windward header section of the upper header tank, the cap being located at the end where the refrigerant inlet is provided.

The heat exchanger disclosed in the above-mentioned publication is manufactured by brazing all the components together in a furnace in a state in which all the components are assembled and provisionally fixed by an appropriate jig.

However, the heat exchanger disclosed in the above-mentioned publication has a possibility that, when the provisionally fixed assembly of all the components is placed in the brazing furnace during the manufacture of the heat exchanger, the end members may come off the combination of the first to third members which constitute the tank main body of the header tank.

In order to solve such a problem, the present applicant has proposed an improved heat exchanger (refer to Japanese Patent Application Laid-Open (kokai) No. 2011-64379). In the improved heat exchanger, the first member of the tank main body of each header tank has, at each of the longitudinal opposite ends of each vertical wall portion, a protrusion which extends straight from the vertical wall portion toward the side opposite the heat exchange tubes. The engagement claws of each end member of the header tank has first and second portions. The first portion extends, along the edge of the protrusion opposite the heat exchange tubes and beyond the protrusion, toward the longitudinal center of the tank main body. The second portion projects from the distal end of the first portion toward the heat exchange tubes, and comes into engagement with the edge of the protrusion of the first member located on the side toward the longitudinal center of the header tank. According to the heat exchanger disclosed in the second publication, it is possible to prevent the end members from coming off the tank main body to the outer side with respect to the longitudinal direction thereof when the provisionally fixed assembly of all the components is placed in the brazing furnace during the manufacture of the heat exchanger.

However, the heat exchanger disclosed in the second publication has a possibility that, when the provisionally fixed assembly of all the components is placed in the brazing furnace during the manufacture of the heat exchanger, the first to third members which constitute the tank main body of the header tank positionally shift because of an insufficient force for restraining the combination of the first to third members from the front and rear sides.

SUMMARY OF THE INVENTION

An object of the present invention is to solve the above problem and to provide a heat exchanger which can prevent coming off of the end members of each header tank and positional shift of members which constitute the tank main body of the header tank, which would otherwise occur when all the components are assembled during manufacture of the heat exchanger.

To fulfill the above object, the present invention comprises the following modes.

1) A heat exchanger comprising a heat exchange core section which includes a plurality of heat exchange tubes disposed such that their longitudinal direction coincides with a vertical direction, and header tanks which are disposed on the upper and lower sides of the heat exchange core section such that their longitudinal direction coincides with an arrangement direction of the heat exchange tubes, each header tank being composed of a tank main body whose opposite ends are open and end members brazed to the opposite ends of the tank main body so as to close openings at the opposite ends, the tank main body of each header tank being composed of a first member which forms a portion of the tank main body on the side toward the heat exchange core section and to which the heat exchange tubes are connected, a second member which forms the remaining portion of the tank main body, and a third member which is disposed between the first member and the second member and is brazed to these members and which has a partition portion for vertically dividing the interior of the header tank into two spaces, the first member and the second member having, at each of front and rear side edges thereof, vertical wall portions which partially overlap each other as viewed from the front side and which are provided such that each vertical wall portion of the second member is located on the inner side of the corresponding vertical wall portion of the first member with a gap formed therebetween, the third member having, at each of the front and rear side edges thereof, a vertical wall portion which is disposed in the gap between the corresponding vertical wall portions of the first and second members and is brazed to the vertical wall portions, and a horizontal wall portion which is provided at the distal end of the vertical portion and projects outward in the front-rear direction and to which the distal end of the corresponding vertical wall portion of the first member is brazed, and each of the end members of each header tank having engagement claws which project toward the center of the header tank with respect to the longitudinal direction thereof and which are brazed to the tank main body in a state in which the engagement claws are engaged with the tank main body, wherein a protrusion is provided at each of longitudinal opposite ends of each vertical wall portion of the first member of the tank main body of each header tank such that the protrusion extends straight from the vertical wall portion outward in the vertical direction, longitudinal opposite end portions of each horizontal wall portion of the third member of the tank main body are cut away, and the third member is provided with a protrusion which is provided at each of longitudinal opposite ends of each vertical wall portion of the third member, which is overlappingly located on the inner side of the corresponding protrusion of the first member, and which is brazed to the corresponding protrusion; and each of the engagement claws of the end members of each header tank has a first portion which extends along an outer surface of the corresponding protrusion of the first member, the outer surface being located on the outer side in the front-rear direction, and which is brazed to the corresponding protrusion, and a second portion which extends from the distal end of the first portion and is bent inward in the front-rear direction such that the second portion comes into engagement with the corresponding protrusion of the first member, and a distal end portion of the second portion is located inward in the front-rear direction in relation to the outer surface of the corresponding protrusion of the first member.

2) A heat exchanger according to par. 1), wherein the second portion of each engagement claw of the end members of each header tank inclines inward in the front-rear direction such that the inclination starts from the proximal end of the second portion on the side toward the first portion and continues up to the distal end of the second portion.

3) A heat exchanger according to par. 1), wherein the second portion of each engagement claw of the end members of each header tank extends along surfaces of the corresponding protrusions of the first and third members, the surfaces facing toward the center of the header tank with respect to the longitudinal direction thereof, and is brazed to the corresponding protrusions.

4) A heat exchanger comprising a heat exchange core section which includes a plurality of heat exchange tubes disposed such that their longitudinal direction coincides with a vertical direction, and header tanks which are disposed on the upper and lower sides of the heat exchange core section such that their longitudinal direction coincides with an arrangement direction of the heat exchange tubes, each header tank being composed of a tank main body whose opposite ends are open and end members brazed to the opposite ends of the tank main body so as to close openings at the opposite ends, the tank main body of each header tank being composed of a first member which forms a portion of the tank main body on the side toward the heat exchange core section and to which the heat exchange tubes are connected, a second member which forms the remaining portion of the tank main body, and a third member which is disposed between the first member and the second member and is brazed to these members and which has a partition portion for vertically dividing the interior of the header tank into two spaces, the first member and the second member having, at each of front and rear side edges thereof, vertical wall portions which partially overlap each other as viewed from the front side and which are provided such that each vertical wall portion of the second member is located on the inner side of the corresponding vertical wall portion of the first member with a gap formed therebetween, the third member having, at each of the front and rear side edges thereof, a vertical wall portion which is disposed in the gap between the corresponding vertical wall portions of the first and second members and is brazed to the vertical wall portions, and a horizontal wall portion which is provided at the distal end of the vertical portion and projects outward in the front-rear direction and to which the distal end of the corresponding vertical wall portion of the first member is brazed, and each of the end members of each header tank having engagement claws which project toward the center of the header tank with respect to the longitudinal direction thereof and which are brazed to the tank main body in a state in which the engagement claws are engaged with the tank main body, wherein a protrusion is provided at each of longitudinal opposite ends of each vertical wall portion of the first member of the tank main body of each header tank such that the protrusion extends straight from the vertical wall portion outward in the vertical direction, longitudinal opposite end portions of each horizontal wall portion of the third member of the tank main body are cut away, and the third member is provided with a protrusion which is provided at each of longitudinal opposite ends of each vertical wall portion of the third member, which is overlappingly located on the inner side of the corresponding protrusion of the first member, and which is brazed to the corresponding protrusion; and each of the engagement claws of the end members of each header tank has a first portion which extends along projecting end surfaces of the corresponding protrusions of the first and third members, and which is brazed to the two corresponding protrusions, and a second portion which extends from the distal end of the first portion and is bent inward in the vertical direction such that the second portion comes into engagement with the corresponding protrusion of the first member, and a distal end portion of the second portion is located inward in the vertical direction in relation to the projecting end surface of the corresponding protrusion of the first member.

5) A heat exchanger according to par. 4), wherein the second portion of each engagement claw of the end members of each header tank inclines inward in the vertical direction such that the inclination starts from the proximal end of the second portion on the side toward the first portion and continues up to the distal end of the second portion.

6) A heat exchanger according to par. 4), wherein the second portion of each engagement claw of the end members of each header tank extends along surfaces of the corresponding protrusions of the first and third members, the surfaces facing toward the center of the header tank with respect to the longitudinal direction thereof, and is brazed to the corresponding protrusions.

7) A heat exchanger comprising a heat exchange core section which includes a plurality of heat exchange tubes disposed such that their longitudinal direction coincides with a vertical direction, and header tanks which are disposed on the upper and lower sides of the heat exchange core section such that their longitudinal direction coincides with an arrangement direction of the heat exchange tubes, each header tank being composed of a tank main body whose opposite ends are open and end members brazed to the opposite ends of the tank main body so as to close openings at the opposite ends, the tank main body of each header tank being composed of a first member which forms a portion of the tank main body on the side toward the heat exchange core section and to which the heat exchange tubes are connected, a second member which forms the remaining portion of the tank main body, and a third member which is disposed between the first member and the second member and is brazed to these members and which has a partition portion for vertically dividing the interior of the header tank into two spaces, the first member and the second member having, at each of front and rear side edges thereof, vertical wall portions which partially overlap each other as viewed from the front side and which are provided such that each vertical wall portion of the second member is located on the inner side of the corresponding vertical wall portion of the first member with a gap formed therebetween, the third member having, at each of the front and rear side edges thereof, a vertical wall portion which is disposed in the gap between the corresponding vertical wall portions of the first and second members and is brazed to the vertical wall portions, and each of the end members of each header tank having engagement claws which project toward the center of the header tank with respect to the longitudinal direction thereof and which are brazed to the tank main body in a state in which the engagement claws are engaged with the tank main body, wherein each vertical wall portion of the first and third members of the tank main body of each header tank has openings which are provided at locations near the opposite ends of the vertical wall portion so as to expose the corresponding vertical wall portion of the second member outward in the front-rear direction; and each of the engagement claws of the end members of each header tank has a first portion which extends along an outer surface of a portion of the corresponding vertical wall portion of the first member, the portion being located on the outer side of the corresponding opening in the longitudinal direction of the header tank, and which is brazed to the corresponding vertical wall portion, and a second portion which extends from the distal end of the first portion and is bent inward in the front-rear direction such that the second portion comes into engagement with the portion of the corresponding vertical wall portion of the first member, the portion being located on the outer side of the corresponding opening in the longitudinal direction of the header tank, and a distal end portion of the second portion is located inward in the front-rear direction in relation to an outer surface of the corresponding vertical wall portion of the first member, the outer surface being located on the outer side in the front-rear direction.

8) A heat exchanger according to par. 7), wherein the second portion of each engagement claw of the end members of each header tank inclines inward in the front-rear direction such that the inclination starts from the proximal end of the second portion on the side toward the first portion and continues up to the distal end of the second portion.

9) A heat exchanger according to par. 7), wherein the second portion of each engagement claw of the end members of each header tank is located in the corresponding openings of the corresponding vertical wall potions of the first and third members, extends along wall surfaces of the openings, the wall surfaces facing toward the center of the header tank with respect to the longitudinal direction thereof, and is brazed to the wall surfaces.

In the heat exchanger according to any one of pars. 1) to 3), a protrusion is provided at each of longitudinal opposite ends of each vertical wall portion of the first member of the tank main body of each header tank such that the protrusion extends straight from the vertical wall portion outward in the vertical direction, longitudinal opposite end portions of each horizontal wall portion of the third member of the tank main body are cut away, and the third member is provided with a protrusion which is provided at each of longitudinal opposite ends of each vertical wall portion of the third member, which is overlappingly located on the inner side of the corresponding protrusion of the first member, and which is brazed to the corresponding protrusion; and each of the engagement claws of the end members of each header tank has a first portion which extends along an outer surface of the corresponding protrusion of the first member, the outer surface being located on the outer side in the front-rear direction, and which is brazed to the corresponding protrusion, and a second portion which extends from the distal end of the first portion and is bent inward in the front-rear direction such that the second portion comes into engagement with the corresponding protrusion of the first member, and a distal end portion of the second portion is located inward in the front-rear direction in relation to the outer surface of the corresponding protrusion of the first member. Therefore, when all the components are assembled and fixed provisionally during manufacture of the heat exchanger, by the action of the second portion of each engagement claw, the end members are prevented from coming off the members constituting the tank main body outward in the longitudinal direction of the tank main body. In addition, when all the components are assembled during manufacture of the heat exchanger, by the action of the second portion of each engagement claw, forces are applied to the members constituting the tank main body so as to retain them from the front and rear sides, to thereby prevent positional shift of the members constituting the tank main body.

In the heat exchanger according to any one of pars. 4) to 6), a protrusion is provided at each of longitudinal opposite ends of each vertical wall portion of the first member of the tank main body of each header tank such that the protrusion extends straight from the vertical wall portion outward in the vertical direction, longitudinal opposite end portions of each horizontal wall portion of the third member of the tank main body are cut away, and the third member is provided with a protrusion which is provided at each of longitudinal opposite ends of each vertical wall portion of the third member, which is overlappingly located on the inner side of the corresponding protrusion of the first member, and which is brazed to the corresponding protrusion; and each of the engagement claws of the end members of each header tank has a first portion which extends along projecting end surfaces of the corresponding protrusions of the first and third members, and which is brazed to the two corresponding protrusions, and a second portion which extends from the distal end of the first portion and is bent inward in the vertical direction such that the second portion comes into engagement with the corresponding protrusion of the first member, and a distal end portion of the second portion is located inward in the vertical direction in relation to the projecting end surface of the corresponding protrusion of the first member. Therefore, when all the components are assembled and fixed provisionally during manufacture of the heat exchanger, by the action of the second portion of each engagement claw, the end members are prevented from coming off the members constituting the tank main body outward in the longitudinal direction of the tank main body. In addition, when all the components are assembled during manufacture of the heat exchanger, by the action of the second portion of each engagement claw, forces are applied to the members constituting the tank main body so as to retain them from the front and rear sides, to thereby prevent positional shift of the members constituting the tank main body.

In the heat exchanger according to any one of pars. 7) to 9), each vertical wall portion of the first and third members of the tank main body of each header tank has openings which are provided at locations near the opposite ends of the vertical wall portion so as to expose the corresponding vertical wall portion of the second member outward in the front-rear direction; and each of the engagement claws of the end members of each header tank has a first portion which extends along an outer surface of a portion of the corresponding vertical wall portion of the first member, the portion being located on the outer side of the corresponding opening in the longitudinal direction of the header tank, and which is brazed to the corresponding vertical wall portion, and a second portion which extends from the distal end of the first portion and is bent inward in the front-rear direction such that the second portion comes into engagement with the portion of the corresponding vertical wall portion of the first member, the portion being located on the outer side of the corresponding opening in the longitudinal direction of the header tank, and a distal end portion of the second portion is located inward in the front-rear direction in relation to an outer surface of the corresponding vertical wall portion of the first member, the outer surface being located on the outer side in the front-rear direction. Therefore, when all the components are assembled and fixed provisionally during manufacture of the heat exchanger, by the action of the second portion of each engagement claw, the end members are prevented from coming off the members constituting the tank main body outward in the longitudinal direction of the tank main body. In addition, when all the components are assembled during manufacture of the heat exchanger, by the action of the second portion of each engagement claw, forces are applied to the members constituting the tank main body so as to retain them from the front and rear sides, to thereby prevent positional shift of the members constituting the tank main body.

DESCRIPTION OF THE PREFERRED EMBODIMENTS

Figure 1:
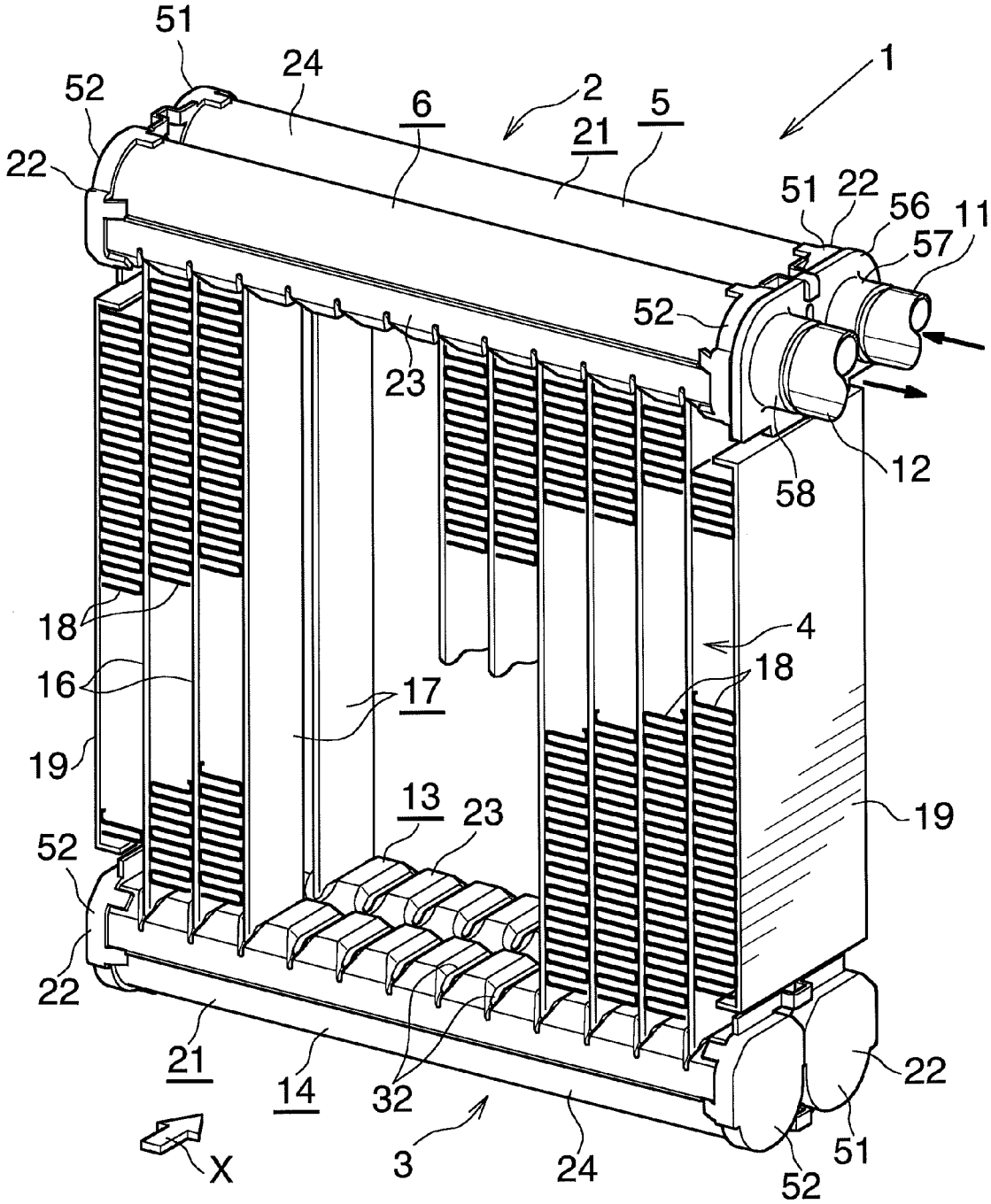
FIG. 1 is a partially cut-away perspective view showing the overall structure of an evaporator to which a heat exchanger according to the present invention is applied.

Embodiments of the present invention will next be described with reference to the drawings. The embodiments are implemented by applying a heat exchanger according to the present invention to an evaporator of a car air conditioner.

Notably, in the following description, the term "aluminum" encompasses aluminum alloys in addition to pure aluminum.

Identical portions and identical members are denoted by the same reference numerals throughout the drawings, and redundant descriptions are eliminated.

Figure 2:
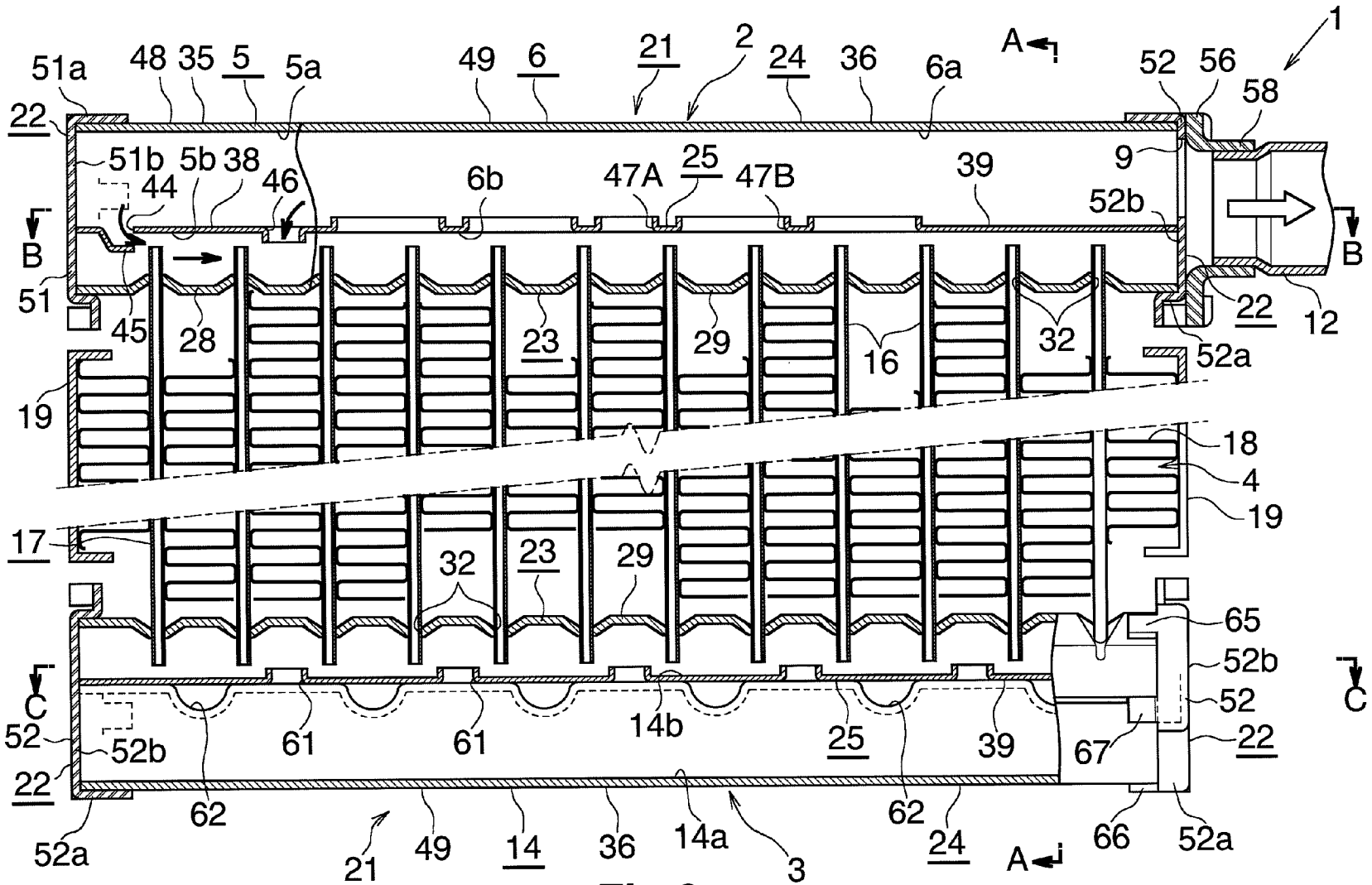
FIG. 2 is a partially omitted vertical sectional view of the evaporator of FIG. 1 as viewed from the rear side thereof.
Figure 3:
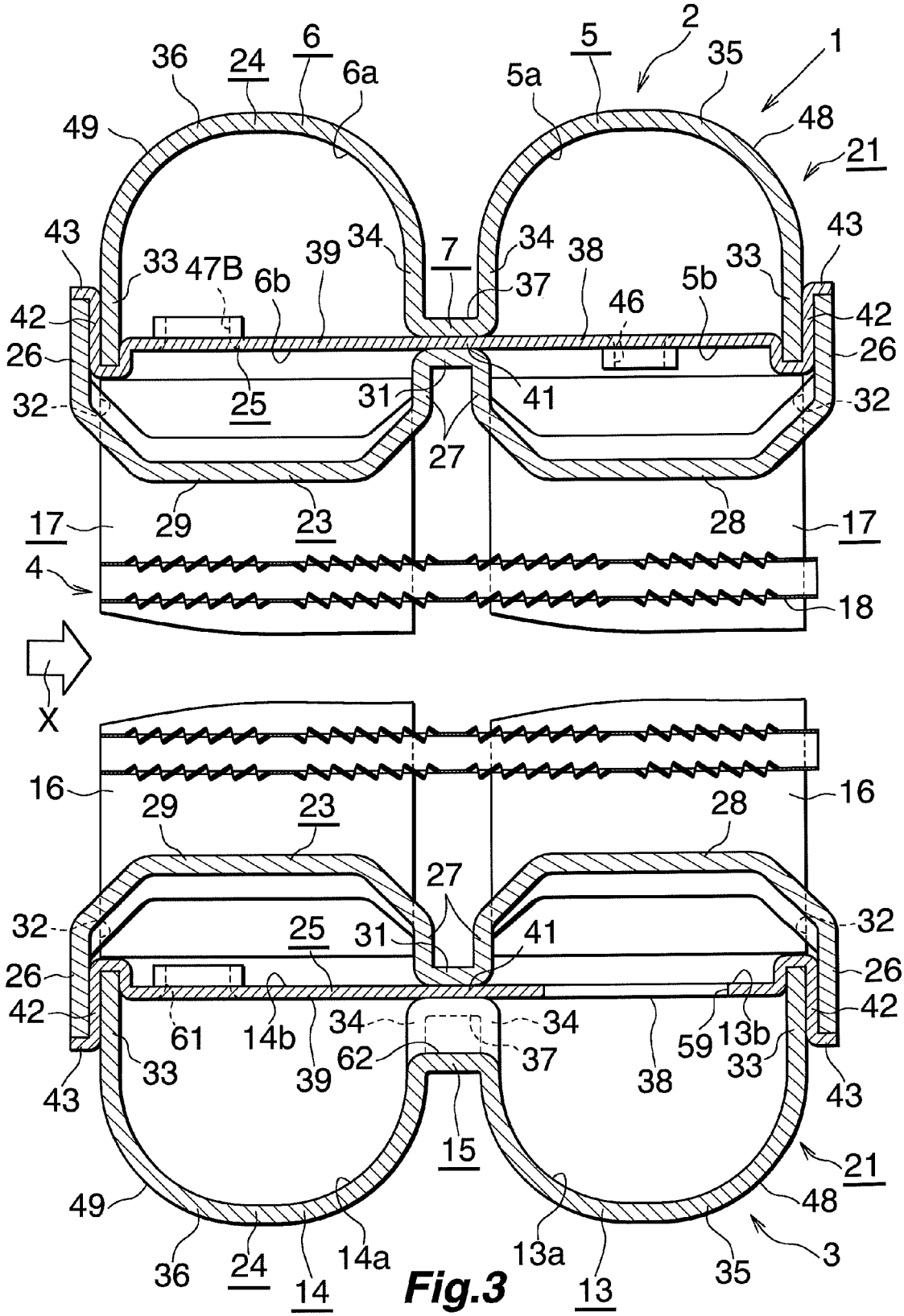
FIG. 3 is a partially omitted enlarged sectional view taken along line A-A of FIG. 2.
Figure 4:
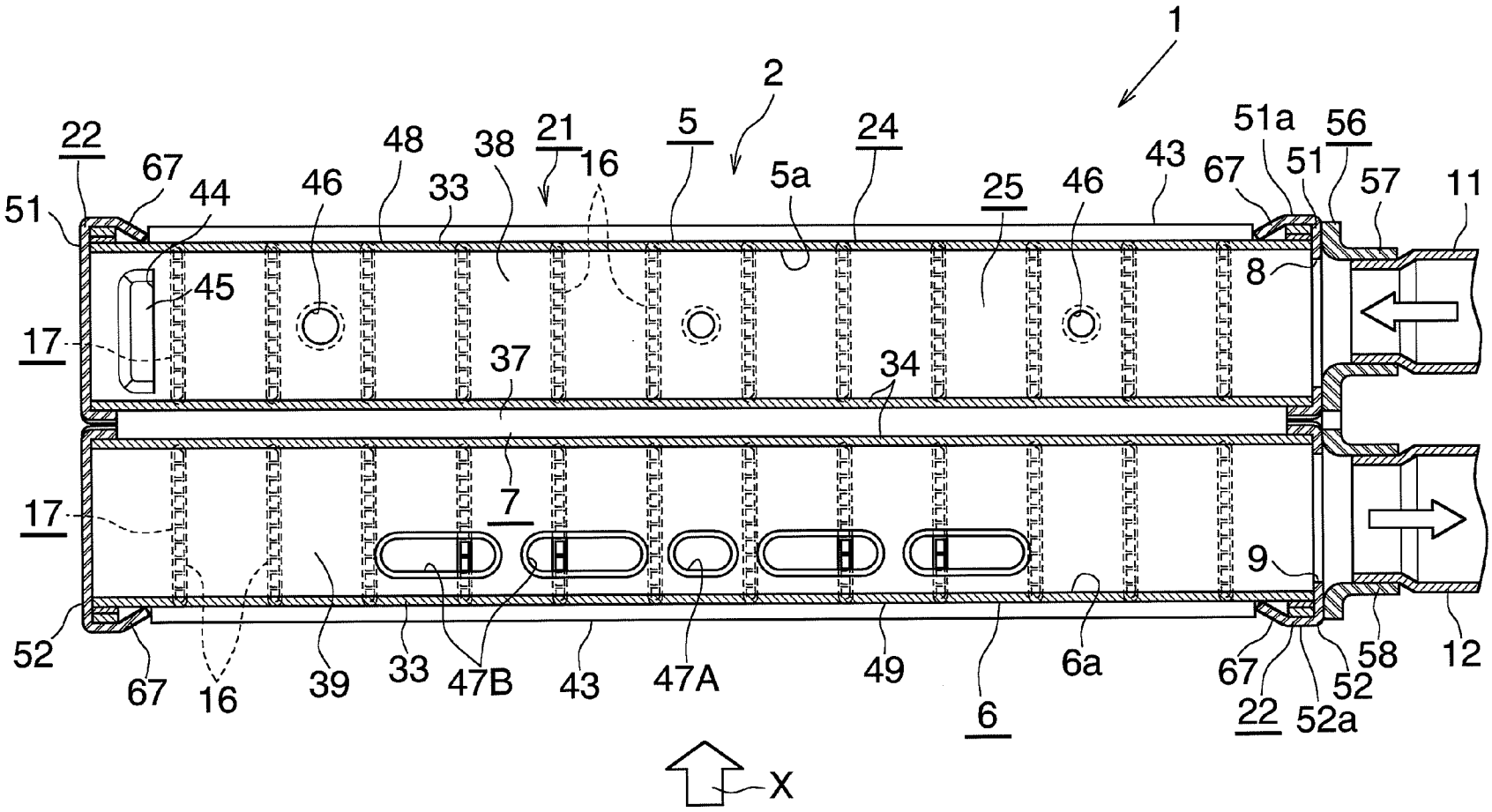
FIG. 4 is a sectional view taken along line B-B of FIG. 2.

FIGS. 1 to 3 show the overall structure of an evaporator, and FIGS. 4 to 9 show the configuration of a main portion of the evaporator.

As shown in FIGS. 1 to 5, an evaporator 1 includes a first header tank 2 and a second header tank 3 formed of aluminum and disposed apart from each other in the vertical direction such that they extend in the left-right direction; and a heat exchange core section 4 provided between the two header tanks 2 and 3.

The first header tank 2 includes a leeward upper header section 5 which is located on the front side (downstream side with respect to the air-passing direction) and which extends in the left-right direction; a windward upper header section 6 which is located on the rear side (upstream side with respect to the air-passing direction) and which extends in the left-right direction; and a connection portion 7 which connects and unites the two header sections 5 and 6 together. The leeward upper header section 5, of the first header tank 2 has a refrigerant inflow port 8 at its right end, and the left end of the leeward upper header section 5 is closed. Similarly, the windward upper header section 6 of the first header tank 2 has a refrigerant outflow port 9 at its right end, and the left end of the windward upper header section 6 is closed. A refrigerant inlet pipe 11 formed of aluminum is connected to the leeward upper header section 5 of the first header tank 2 such that the refrigerant inlet pipe 11 communicates with the refrigerant inflow port 8. Similarly, a refrigerant outlet pipe 12 formed of aluminum is connected to the windward upper header section 6 of the first header tank 2 such that the refrigerant outlet pipe 12 communicates with the refrigerant outflow port 9. The second header tank 3 includes a leeward lower header section 13 which is located on the front side and which extends in the left-right direction; a windward lower header section 14 which is located on the rear side and which extends in the left-right direction; and a connection portion 15 which connects and unites the two header sections 13 and 14 together.

The heat exchange core section 4 is configured such that heat exchange tube groups 17 are arranged in a plurality of; herein, two, rows in the front-rear direction, each heat exchange tube group 17 consisting of a plurality of heat exchange tubes 16 arranged in parallel at predetermined intervals in the left-right direction such that the longitudinal direction of the heat exchange tubes 16 coincides with the vertical direction. Corrugate fins 18 are disposed within corresponding air-passing clearances between the adjacent heat exchange tubes 16 of the heat exchange tube groups 17 and on the outer sides of the leftmost and rightmost heat exchange tubes 16 of the heat exchange tube groups 17, and are brazed to the corresponding heat exchange tubes 16. Side plates 19 made of aluminum are disposed on the outer sides of the leftmost and rightmost corrugate fins 18, and are brazed to the corresponding corrugate fins 18. Upper and lower end portions of the heat exchange tubes 16 of the front heat exchange tube group 17 are connected to the leeward upper header section 5 and the leeward lower header section 13, respectively. Upper and lower end portions of the heat exchange tubes 16 of the rear heat exchange tube group 17 are connected to the windward upper header section 6 and the windward lower header section 14, respectively.

Each of the heat exchange tubes 16 is a flat heat exchange tube which is formed from a bare material (a section formed through extrusion of aluminum), is disposed such that its width direction coincides with the front-rear direction, and has a plurality of refrigerant channels arranged in the width direction. The corrugate fins 18 are shared by the front and rear heat exchange tubes 16 which constitute the front and rear heat exchange tube groups 17, and the width of the corrugate fins 18 in the front-rear direction is approximately equal to the distance between the front side edges of the front heat exchange tubes 16 and the rear side edges of the rear heat exchange tubes 16. Notably, instead of disposing the corrugate fins 18 such that a single corrugate fin 18 is shared by the front and rear heat exchange tube groups 17, the corrugate fins 18 may be disposed such that a corrugate fin is disposed between adjacent heat exchange tubes 16 of each of the two heat exchange tube groups 17.

The first header tank 2 is composed of a tank main body 21 whose opposite ends are open; and end members 22 which are brazed to the opposite ends of the tank main body 21 so as to close the openings at the opposite ends of the tank main body 21.

The tank main body 21 of the first header tank 2 is composed of a first member 23, a second member 24, and a third member 25. Each of the first and second members 23 and 24 is formed by performing press work on an aluminum brazing sheet having a brazing material layer on each of opposite sides thereof. The third member 25 is formed by performing press work on an aluminum bare material or an aluminum brazing sheet having a brazing material layer on each of opposite sides thereof. The first member 23 forms a portion (a lower portion) of the tank main body 21 on the side toward the heat exchange core section 4, and upper end portions of the heat exchange tubes 16 of the front and rear heat exchange tube groups 17 are connected to the first member 23. The second member 24 forms the remaining portion (an upper portion) of the tank main body 21. The third member 25 is disposed between the first member 23 and the second member 24, and is brazed to the two members.

The first member 23 of the tank main body 21 of the first header tank 2 is composed of front and rear vertical side walls 26 (vertical wall portions) extending in the left-right direction; front and rear vertical intermediate walls 27 which are provided at an intermediate position with respect to the front-rear direction such that they are spaced from each other in the front-rear direction and which extend in the left-right direction; a generally U-shaped front connection wall 28 which bulges downward and which connects together the lower ends of the front side wall 26 and the front intermediate wall 27; a generally U-shaped rear connection wall 29 which bulges downward and which connects together the lower ends of the rear side wall 27 and the rear intermediate wall 27; and a horizontal connection wall 31 which connects together the front and rear intermediate walls 27. A lower portion of the leeward upper header section 5 is formed by the front side wall 26, the front intermediate wall 27, and the front connection wall 28. A lower portion of the windward upper header section 6 is formed by the rear side wall 26, the rear intermediate wall 27, and the rear connection wall 29. A lower portion of the connection portion 7 is formed by the horizontal connection wall 31. A plurality of tube insertion holes 32 elongated in the front-rear direction are formed in each of the front and rear connection walls 28 and 29 of the first member 23 such that the tube insertion holes 32 are spaced from one another in the left-right direction, and the tube insertion holes 32 of the front connection wall 28 are located at the same positions as those of the rear connection wall 29 with respect to the left-right direction. The upper end portions of the heat exchange tubes 16 are inserted into the tube insertion holes 32 and are brazed to the first member 23.

The second member 24 of the tank main body 21 of the first header tank 2 is composed of front and rear vertical side walls 33 (vertical wall portions) extending in the left-right direction; front and rear vertical intermediate walls 34 which are provided at an intermediate position with respect to the front-rear direction such that they are spaced from each other in the front-rear direction and which extend in the left-right direction; a front connection wall 35 which bulges upward and has an arcuate transverse cross section and which connects together the upper ends of the front side wall 33 and the front intermediate wall 34; a rear connection wall 36 which bulges upward and has an arcuate transverse cross section and which connects together the upper ends of the rear side wall 33 and the rear intermediate wall 34; and a horizontal connection wall 37 which connects together the front and rear intermediate walls 34. Lower portions of the front and rear side walls 33 overlap with upper portions of the front and rear side walls 26 of the first member 23 as viewed from the front side, and are located inward of the front and rear side walls 26 of the first member 23 with respect to the front-rear direction such that gaps are formed between the lower portions of the front and rear side walls 33 and the upper portions of the front and rear side walls 26. An upper portion of the leeward upper header section 5 is formed by the front side wall 33, the front intermediate wall 34, and the front connection wall 35. An upper portion of the windward upper header section 6 is formed by the rear side wall 33, the rear intermediate wall 34, and the rear connection wall 36. An upper portion of the connection portion 7 is formed by the horizontal connection wall 37.

The third member 25 of the tank main body 21 of the first header tank 2 is composed of a horizontal front partition wall 38 (partition portion) which divides the interior of the leeward upper header section 5 into an upper first space 5*a* and a lower second space 5*b*; a horizontal rear partition wall 39 (partition portion) which divides the interior of the windward upper header section 6 into an upper first space 6*a* and a lower second space 6*b*; a flat horizontal connection wall 41 which connects the two partition walls 38 and 39, which is sandwiched between the horizontal connection walls 31 and 37 of the first member 23 and the second member 24 and brazed to the two horizontal connection walls 31 and 37, and which forms a center portion of the connection portion 7 with respect to the vertical direction; vertical front and rear side walls 42 (vertical wall portions) which are provided at the front side edge of the front partition wall 38 and the rear side edge of the rear partition wall 39; i.e., the front and rear side edges of the third member 25 and extend in the left-right direction and which are disposed between the front and rear side walls 26 and 33 of the first and second members 23 and 24 and are brazed to the first and second members 23 and 24; and horizontal outward projecting walls 43 (horizontal wall portions) which project outward from the distal ends of the front and rear side walls 42 with respect to the front-rear direction and to which the front and rear side walls 26 of the first member 23 are brazed.

A communication opening 44 is formed in the front partition wall 38 of the third member 25 at a position located leftward of the heat exchange tube 16 disposed at the left end. The communication opening 44, which is elongated in the front-rear direction as viewed from above, establishes communication between the upper and lower spaces 5*a* and 5*b* within the leeward upper header section 5. A guide portion 45 is integrally formed at the left side edge of the communication opening 44 of the front partition wall 38. The guide portion 45 projects toward the second space 5*b*, and guides refrigerant to flow rightward. Also, a plurality of circular communication holes 46 for establishing communication between the upper and lower spaces 5*a* and 5*b* within the leeward upper header section 5 are formed in the front partition wall 38 of the third member 25 at a central position with respect to the front-rear direction such that the communication holes 46 are spaced from one another in the left-right direction. In a rear portion of the rear partition wall 39 of the third member 25, excluding left and right end portions thereof, a plurality of oblong communication holes 47A and 47B which are elongated in the left-right direction and establish communication between the upper and lower spaces 6*a* and 6*b* within the windward header section 6 are formed such that they are spaced from one anther in the left-right direction.

A tubular body 48 whose opposite ends are open and which constitutes the leeward upper header section 5 is formed by the front side wall 26, front intermediate wall 27, and front connection wall 28 of the first member 23, the front side wall 33, front intermediate wall 34, and front connection wall 35 of the second member 24, and the front partition wall 38 and front side wall 42 of the third member 25. Also, a tubular body 49 whose opposite ends are open and which constitutes the windward upper header section 6 is formed by the rear side wall 26, rear intermediate wall 27, and rear connection wall 29 of the first member 23, the rear side wall 33, rear intermediate wall 34, and rear connection wall 36 of the second member 24, and the rear partition wall 39 and rear side wall 42 of the third member 25. The two tubular bodies 48 and 49 are united by the connection portion 7 composed of the connection walls 31, 37, and 41 of the first through third members 23, 24, and 25.

The two end members 22 are composed of front caps 51 which are fitted into the opposite ends of the front tubular body 48 constituting the leeward upper header section 5 and are brazed to the front tubular body 48; rear caps 52 which are fitted into the opposite ends of the rear tubular body 49 constituting the windward upper header section 6 and are brazed to the rear tubular body 49; and upper and lower connection portions 53 which connect the upper portions of the front and rear caps 51 and 52 together and connect the lower portions of the front and rear caps 51 and 52 together. Further, cutouts 54 and 55 for receiving the connection walls 31, 37, and 41 of the first through third tank forming members 23, 24, and 25 are formed in peripheral wall portions 51*a* and 52*a* of the caps 51 and 52 of each end member 22.

The refrigerant inflow port 8, which communicates with the first space 5*a* of the leeward upper header section 5, is formed in a closing wall portion 51*b* of the front cap 51 of the right-side end member 22. Similarly, the refrigerant outflow port 9, which communicates with the first space 6*a* of the windward upper header section 6, is formed in a closing wall portion 52*b* of the rear cap 52 of the right-side end member 22. A joint plate 56 formed of an aluminum bare material is brazed to the right-side end member 22. The joint plate 56 has a refrigerant inflow opening 57 communicating with the refrigerant inflow port 8 and a refrigerant outflow opening 58 communicating with the refrigerant outflow port 9. One end of the refrigerant inlet pipe 11 is inserted into and brazed to the refrigerant inflow opening 57 of the joint plate 56, and one end of the refrigerant outlet pipe 12 is inserted into and brazed to the refrigerant outflow opening 58 of the joint plate 56.

The first header tank 2 and the second header tank 3 are substantially identical in structure and are disposed in a mirror-image relation. Therefore, the same portions are denoted by the same reference numerals.

As shown in FIGS. 2, 3, 6, and 7, the first member 23 of the tank main body 21 of the second header tank 3 forms a portion (an upper portion) of the tank main body 21 located on the side toward the heat exchange core section 4, and lower end portions of the heat exchange tubes 16 of the front and rear heat exchange tube groups 17 are connected o the first member 23. The second member 24 of the tank main body 21 forms the remaining portions (a lower portion) of the tank main body 21. The third member 25 of the tank main body 21 divides the interior of the leeward lower header section 13 and the interior of the windward lower header section 14 into lower first spaces 13*a* and 14*a* and upper second spaces 13*b* and 14*b*.

The second header tank 3 differs from the first header tank 2 in the following points.

The first difference: neither a refrigerant inlet nor a refrigerant outlet is formed in the caps 51 and 52 of the right-side end member 22, and the joint plate 56 is not brazed thereto.

The second difference: the communication opening 44, the guide portion 45, and the circular refrigerant passage holes 46 are not formed in the front partition wall 38 of the third member 25 of the tank main body 21, and communication holes 59 elongated in the left-right direction are formed in the front partition wall 38 so as to establish communication between the first and second spaces 13*a* and 13*b* of the leeward lower header section 13; and the oblong refrigerant passage holes 47A and 47B are not formed in the rear partition wall 39, and a plurality of circular refrigerant passage holes 61 are formed in the rear partition wall 39 such that they are spaced from one another in the left-right direction.

The third difference: a plurality of communication holes 62 for establishing communication between the first spaces 13*a* and 14*a* of the two lower header sections 13 and 14 are formed in the horizontal connection wall 37 and the front and rear intermediate walls 34 of the second member 24 of the tank main body 21 by deforming the second member 24 such that the communication holes 62 are spaced from one another in the left-right direction.

Figure 7:
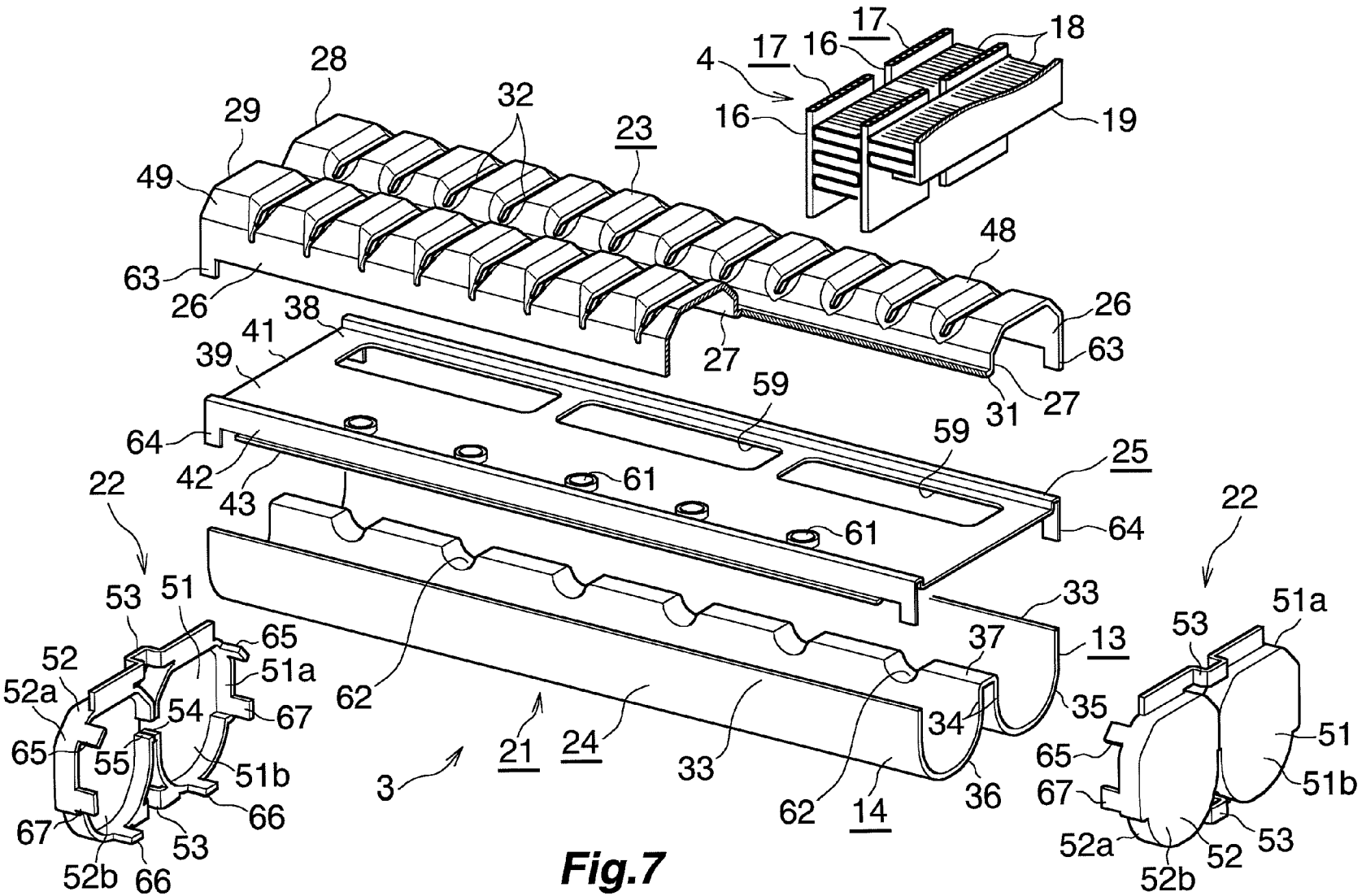
FIG. 7 is an exploded perspective view of a second header tank of the evaporator of FIG. 1.
Figure 8:
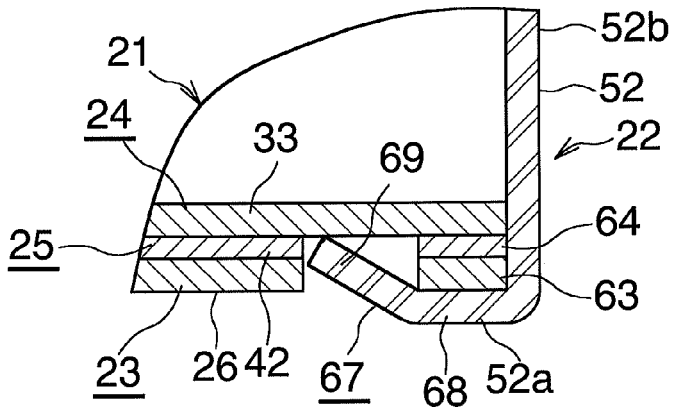
FIG. 8 is, an enlarged view showing a main portion of FIG. 6.
Figure 9:
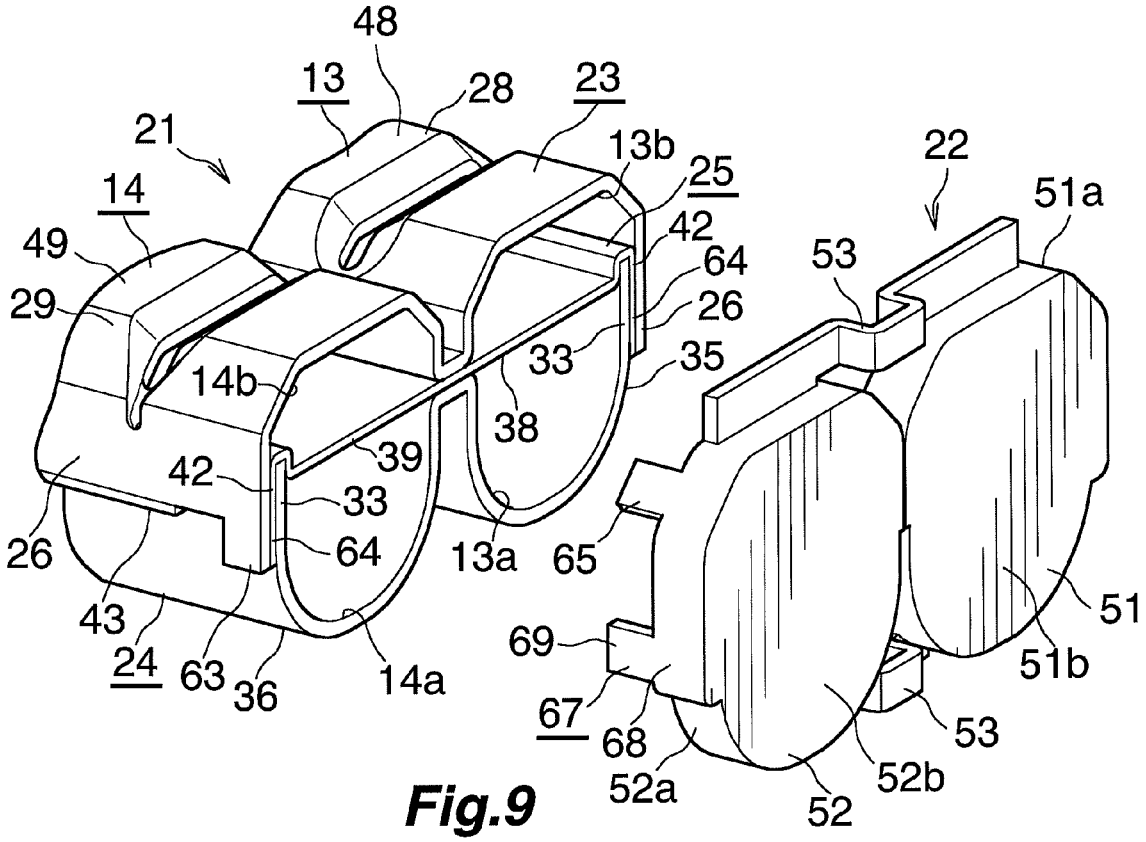
FIG. 9 is an exploded perspective view showing, on an enlarged scale, a right portion of the second header tank of the evaporator of FIG. 1.

Next, the structure of mounting the end members 22 to the tank main body 21 will be described in detail with reference to FIGS. 5 and 7 to 9. FIGS. 8 and 9 show a portion of the second header tank 3.

Vertical protrusions 63 are provided at the left and right ends (opposite ends in the longitudinal direction) of the front and rear side walls 26 of the first member 23 such that the vertical protrusions 63 project straight from the front and rear side walls 26 outward with respect to the vertical direction (toward the side opposite the heat exchange tubes 16). Vertical protrusions 64 are provided at the left and right ends of the front and rear side walls 42 of the third member 25 such that the vertical protrusions 64 project straight from the front and rear side walls 42 outward with respect to the vertical direction. The protrusions 64 are located inward (with respect to the front-rear direction) of the protrusions 63 of the front and rear side walls 26 of the first member 23 such that the protrusions 64 completely overlap with the protrusions 63, and are brazed to the protrusions 63. Also, left and right end portions of the outward projecting wall 43 of the third member 25 are cut away over a range wider than the width of the protrusions 63 and 64 measured in the left-right direction, whereby a gap wider than the width of the protrusions 63 and 64 measured in the left-right direction is provided between the outward projecting wall 43 and the two protrusions 63 and 64 provided at each of the left and right ends.

Holding claws 65 and 66 and an engagement claw 67 are provided on each of the peripheral wall portions 51*a* and 52*a* of the caps 51 and 52 of each end member 22. The holding claw 65 extends along the outer surface of the front or rear connection wall 28 or 29 of the first member 23 of the tank main body 21, and is brazed thereto. The holding claw 66 extends along the outer surface of the front or rear connection wall 35 or 36 of the second member 24. The engagement claw 67 is engaged with the corresponding protrusions 63 and 64 of the first and third members 23 and 25. Each engagement claw 67 of each end member 22 has a first portion 68 and a second portion 69. The first portion 68 projects toward the longitudinal center of the tank main body 21, extends along the outer surface of the corresponding protrusion 63 of the first member 23, and is brazed to the protrusion 63. The second portion 69 extends from the distal end of the first portion 68, and is bent inward in the front-rear direction such that the second portion 69 engages with the corresponding protrusion 63 of the first member 23. Thus, a distal end portion of the second portion 69 enters the gap between the corresponding protrusions 63 and 64 of the first and third members 23 and 25 and the left or right end of the corresponding outward projecting wall 43 of the third member 25, and is located inward (in the front-rear direction) in relation to the outer surface of the corresponding protrusion 63 of the first member 23, the outer surface being located on the outer side with respect to the front-rear direction. In the illustrated example, the first portion 68 of the engagement claw 67 is a part of the peripheral wall portion 51*a* or 52*a* of the cap 51 or 52. However, the present invention is not limited to such a structure. In some cases, the first portion 68 is provided such that the first portion 68 projects from the peripheral wall portion 51*a* or 52*a*. The second portion 69 of each engagement claw 67 inclines inward in the front-rear direction. The inclination starts from the proximal end on the side toward the first portion 68, and continues up to the distal end of the second portion 69. Notably, in FIGS. 5, 7, and 9, the second portion 69 of each engagement claw 67 is shown in a state before being bent; i.e., in a state in which the second portion 69 extends straight from the first portion 68.

Figure 5:
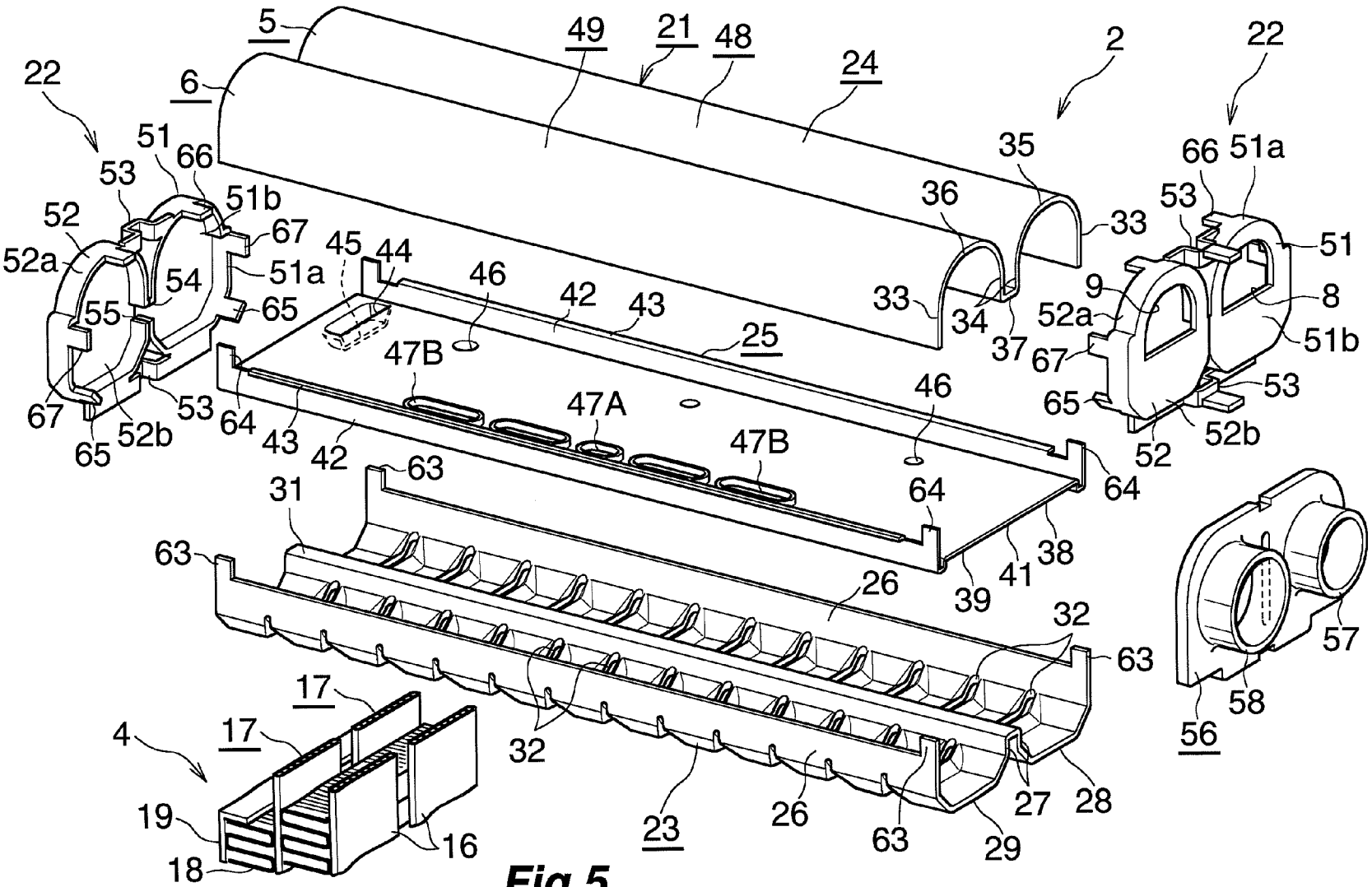
FIG. 5 is an exploded perspective view of a first header tank of the evaporator of FIG. 1.
Figure 6:
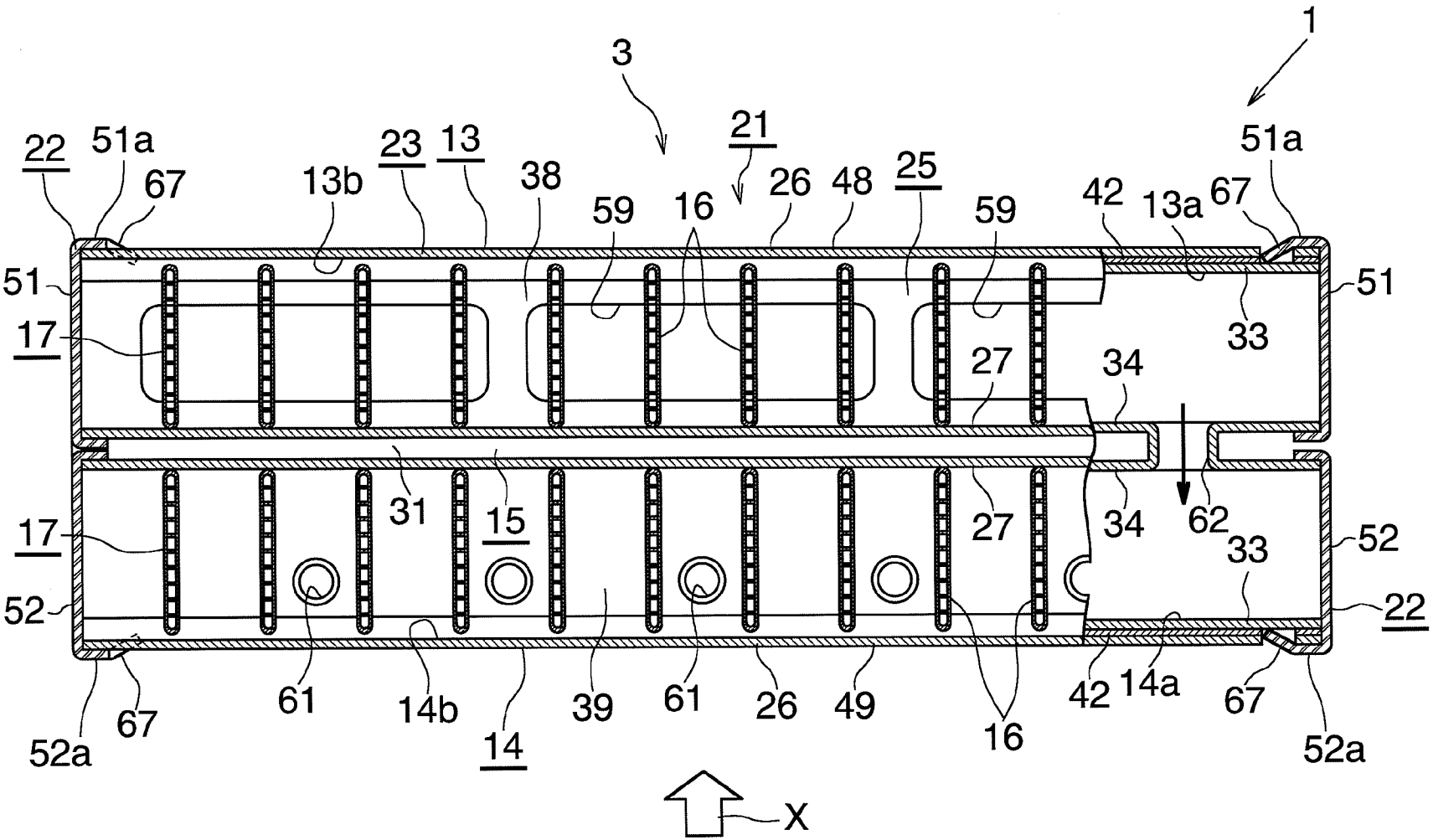
FIG. 6 is a partially cut-away sectional view taken along line C-C of FIG. 2.

The above-described evaporator 1 is manufactured by assembling all the components, excluding the inlet pipe 11 and the outlet pipe 12, provisionally fixing them with an appropriate jig, and brazing together all the components within a furnace. When all the components are assembled, the end members 22 are combined with the first, second, and third members 23, 24, and 25 of the tank main body 21 as follows. Namely, as shown in FIGS. 5, 7, and 9, the second portion 69 of each engagement claw 67 of each end member 22 is formed to extend straight from the first portion 68. Subsequently, the caps 51 and 52 of the left and right end members 22 are fitted into the opposite ends of the tubular bodies 48 and 49 of the tank main body 21, whereby the first portions 68, which are parts of the peripheral wall portions 51*a* and 52*a* are caused to extend along the outer surfaces of the corresponding protrusions 63. After that, the second portion 69 of each engagement claw 67 is bent inward (in the front-rear direction) in relation to the first portion 68 such that the second portion 69 comes into engagement with the corresponding protrusion 63 of the first member 23. Thus, the second portion 69 is caused to incline inward in the front-rear direction from the first portion 68 side toward the distal end thereof. With this operation, the distal end portion of the second portion 69 is caused to enter the gap between the corresponding protrusions 63 and 64 of the first and third members 23 and 25 and the left or right end of the corresponding outward projecting wall 43 of the third member 25, and is located inward (in the front-rear direction) in relation to the outer surface of the corresponding protrusion 63 of the first member 23, the outer surface being located on the outer side with respect to the front-rear direction. At that time, the holding claws 65 and 66 restrain the first, second, and third members 23, 24, and 25 from upper and lower sides, and the engagement claws 67 restrain them from the front and rear sides. Accordingly, the end members 22 are prevented from coming off the first, second, and third members 23, 24, and 25, which constitute the tank main body 21, and positional shift of the first, second, and third members 23, 24, and 25 is prevented.

Figure 10:
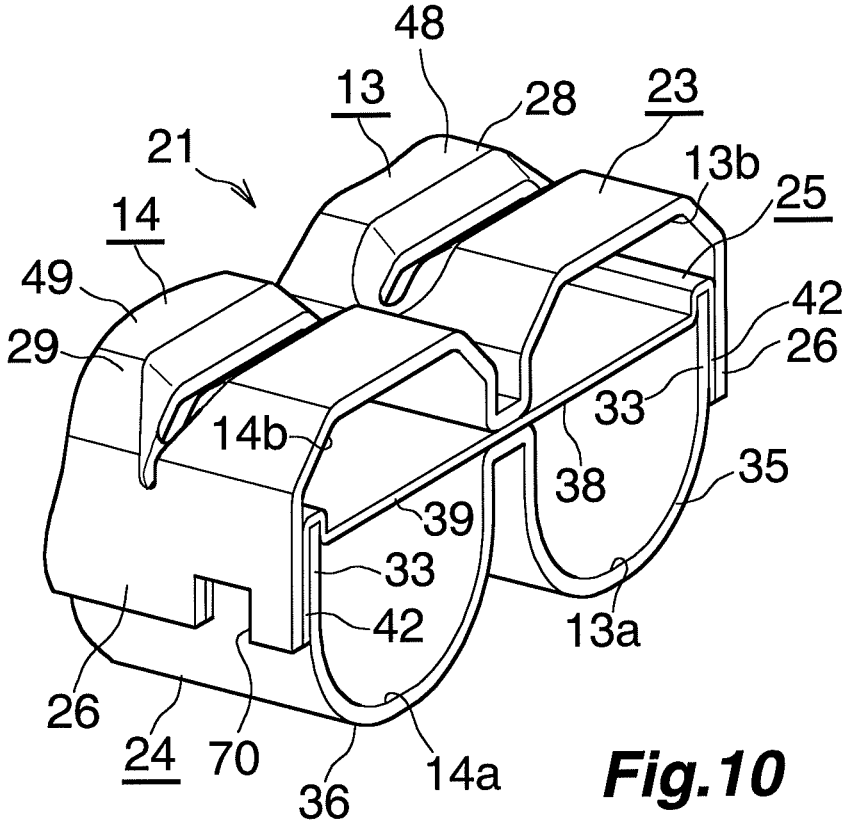
FIG. 10 is a partial perspective view showing a first modification of the tank main body.
Figure 11:
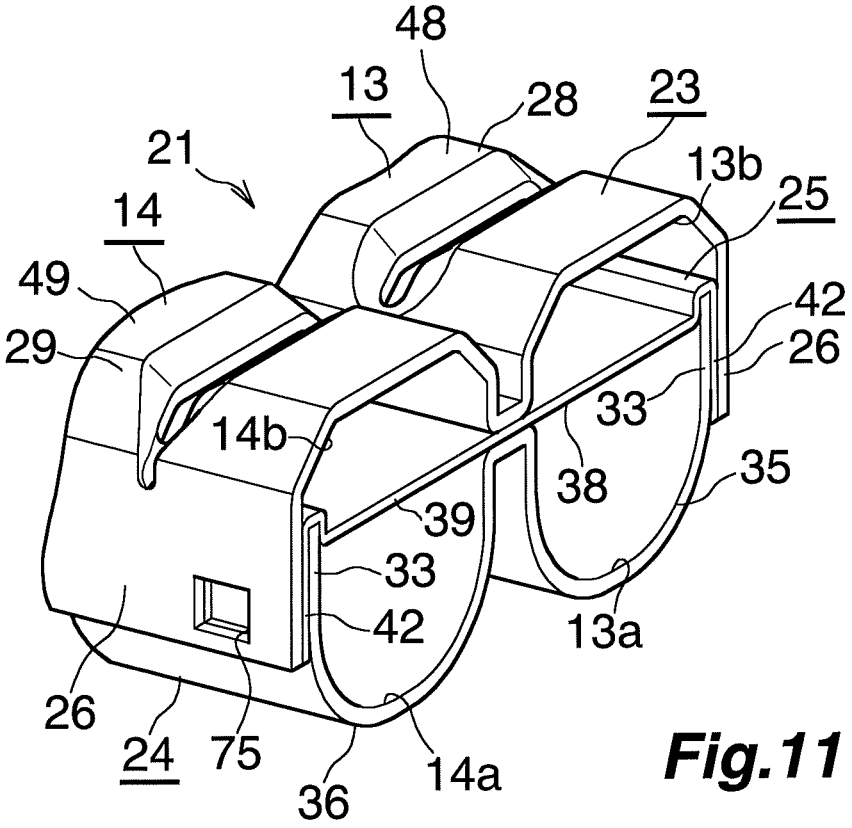
FIG. 11 is a partial perspective view showing a second modification of the tank main body.

FIGS. 10 and 11 show modifications of the tank main body of each header tank.

In the case of the tank main body 21 shown in FIG. 10, the above-mentioned protrusions 63 and 64 are not provided on the front and rear side walls 26 and 42 of the first and third members 23 and 25, and portions of the front and rear side walls 26 and 42 near the left and right ends thereof are cut away from the projecting edges of the front and rear side walls 26 and 42 so as to form openings 70 through which the front and rear side walls 33 of the second member 24 are exposed outward with respect to the front-rear direction.

In the case of the tank main body 21 shown in FIG. 11, the above-mentioned protrusions 63 and 64 are not provided on the front and rear side walls 26 and 42 of the first and third members 23 and 25, and through-holes are formed in portions of the front and rear side walls 26 and 42 near the left and right ends thereof so as to form openings 75 through which the front and rear side walls 33 of the second member 24 are exposed outward with respect to the front-rear direction.

In the case of the tank main bodies 21 having the first and third members 23 and 25 shown in FIGS. 10 and 11, the end member 22 of the above-described embodiment is used. The first portion 68 of each engagement claw 67 of the end member 22 is caused to extend along the outer surface of a portion of the front or rear side wall 26 of the first member 23, the portion being located on the outer side of the opening 70 or 75 with respect to the longitudinal direction of the header tank 2 or 3, and is brazed to the front or rear side wall 26. The second portion 69 extends from the distal end of the first portion 68, and the distal end portion enters the opening 70 or 75. The distal end portion comes into engagement with the edge (located on the outer side with respect to the left-right direction) of the opening 70 or 75 of the front or rear side wall 26 of the first member 23, and is located inward (in the front-rear direction) of the outer surface of the front or rear side wall 26 of the first member 23, the outer surface being located on the outer side with respect to the front-rear direction Notably, in the third member 25 shown in FIGS. 10 and 11, the outward projecting wall 43 may be provided along each of the projecting edges of the front and rear side walls 42.

FIGS. 12 to 17 show modifications of the end members of each header tank.

Figure 12:
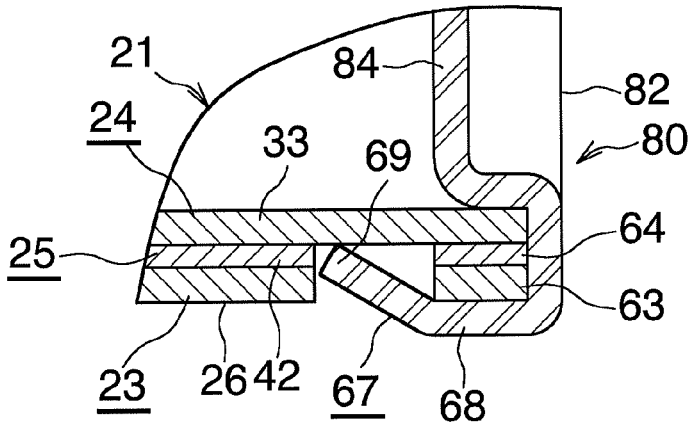
FIG. 12 is a view corresponding to FIG. 8 and showing a first modification of the end member.
Figure 13:
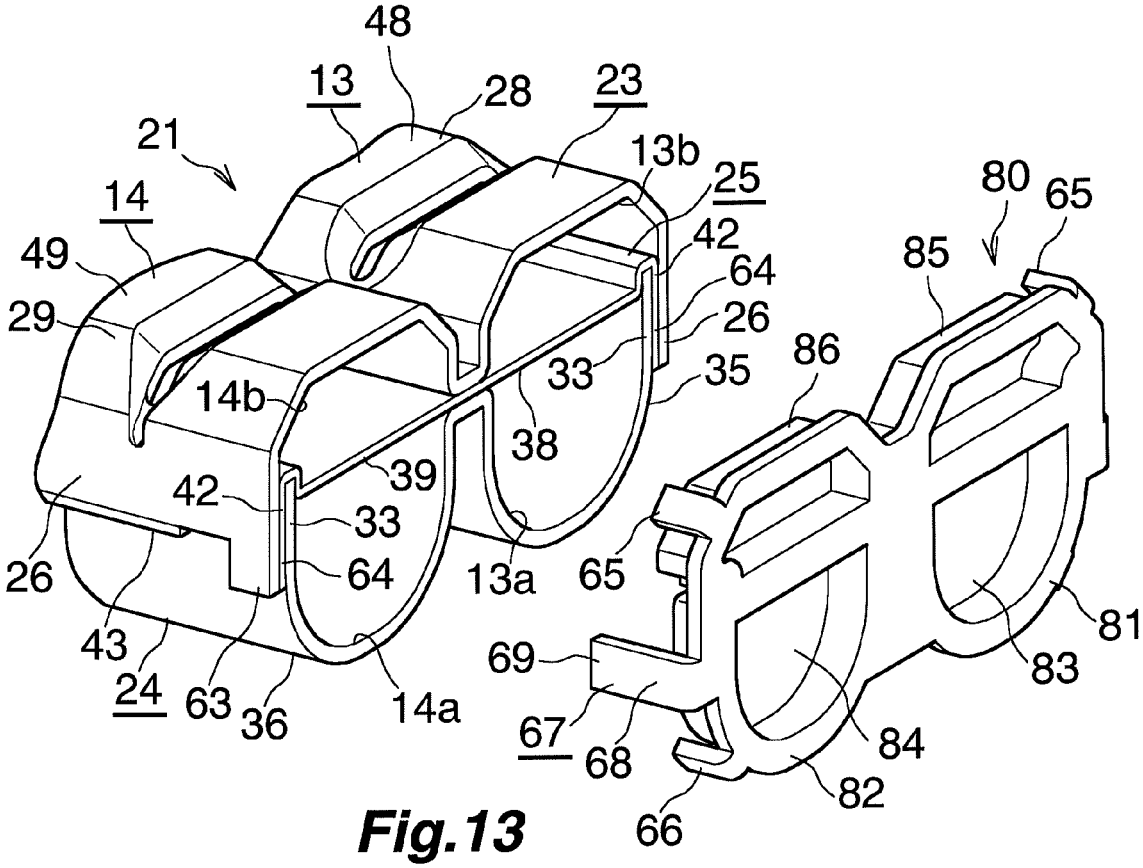
FIG. 13 is a view corresponding to FIG. 9 and showing the end member of FIG. 12.

In the modification shown in FIGS. 12 and 13, each of end members 80 brazed to the opposite ends of the tank main body 21 and closing the openings at the opposite ends of the tank main body 21 has a front cap 81 brazed to the front tubular body 48 and a rear cap 82 brazed to the rear tubular body 49. The caps 81 and 82 of each end member 80 have inward projecting portions 83 and 84 and inward projecting portions 85 and 86, which are separated in the vertical direction. The inward projecting portions 83 and 84 are fitted into the first spaces 5*a* and 6*a* (or 13*a* and 14*a*) of the header sections 5 and 6 (or 13 and 14) of the tank main body 21. The inward projecting portions 85 and 86 are fitted into the second spaces 5*b* and 6*b* (or 13*b* and 14*b*) of the header sections 5 and 6 (or 13 and 14) of the tank main body 21. The refrigerant inlet 8 is formed in a projecting end wall of the inward projecting portion 83 of the front cap 81 of the end member 80 at the right end of the first header tank 2, the inward projecting portion 83 being fitted into the first space 5*a*. Similarly, the refrigerant outlet 9 is formed in a projecting end wall of the inward projecting portion 84 of the rear cap 82 of the end member 80, the inward projecting portion 83 being fitted into the first space 6*a*.

Holding claws 65 and 66 and an engagement claw 67 are provided on each of the caps 81 and 82 of each end member 80. The holding claw 65 extends along the outer surface of the front or rear connection wall 28 or 29 of the first member 23 of the tank main body 21, and is brazed thereto. The holding claw 66 extends along the outer surface of the front or rear connection wall 35 or 36 of the second member 24. The engagement claw 67 is engaged with the corresponding protrusions 63 and 64 of the first and third members 23 and 25. The engagement claws 67 of each member 80 have a structure similar to that of the engagement claws 67 of each member 22 of the above-described embodiment. When all the components are assembled to manufacture an evaporator, the end members 80 are combined with the first, second, and third members 23, 24, and 25 of the tank main body 21 in the same manner as in the above-descried embodiment.

Figure 14:
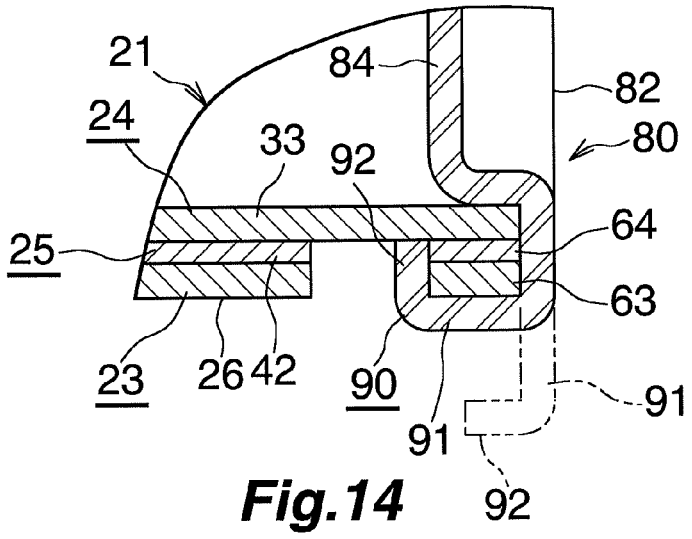
FIG. 14 is a view corresponding to FIG. 8 and showing a second modification of the end member.
Figure 15:
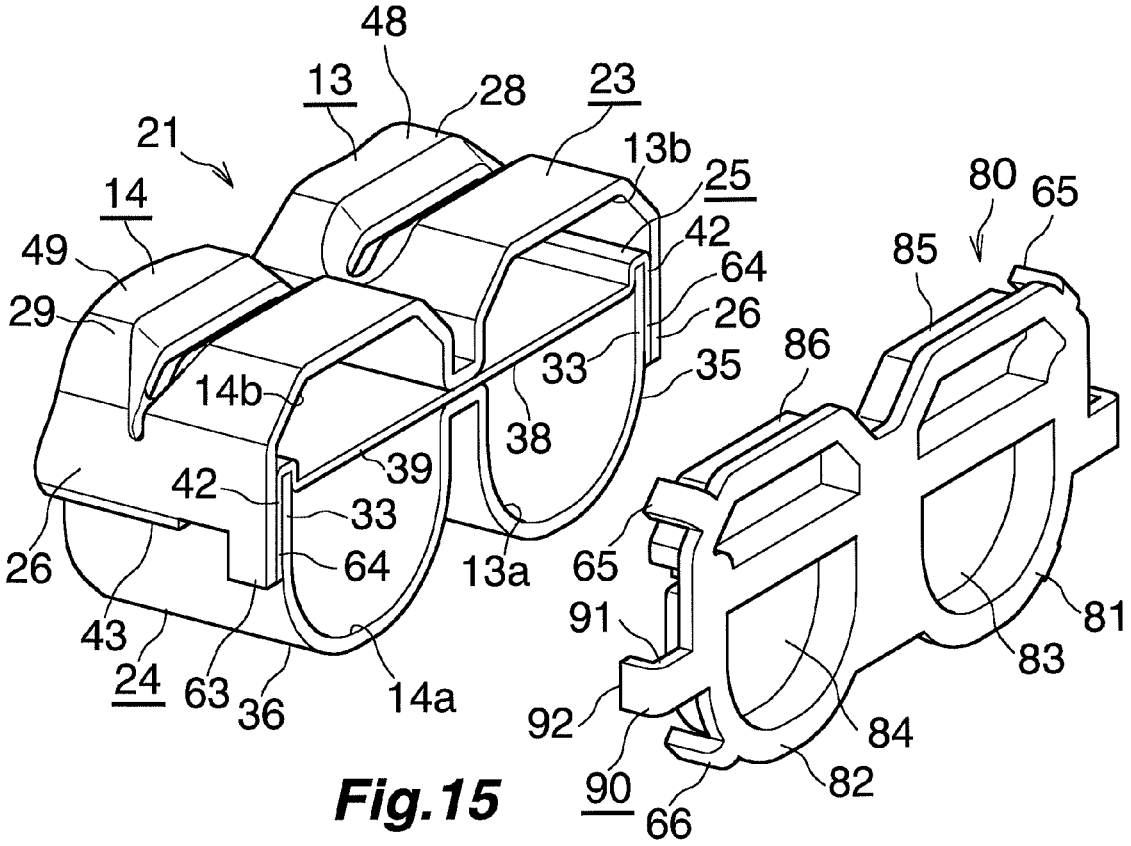
FIG. 15 is a view corresponding to FIG. 9 and showing the end member of FIG. 14.

In the modification shown in FIGS. 14 and 15, each of engagement claws 90 provided on the caps 81 and 82 of each end member 80 and engaged with the protrusions 63 and 64 of the first and third members 23 and 25 has a first portion 91 and a second portion 92. The first portion 91 extends along the outer surface of the corresponding protrusion 63 of the first member 23, and is brazed to the protrusion 63. The second portion 92 extends from the distal end of the first portion 91, and is bent inward in the front-rear direction such that the second portion 92 extends along the surfaces of the protrusions 63 and 64 of the first and third members 23 and 25, the surfaces facing toward the longitudinal center of the tank main body 21. The second portion 92 is brazed to the protrusions 63 and 64. The distal end portion of the second portion 92 enters the gap between the corresponding protrusions 63 and 64 of the first and third members 23 and 25 and the left or right end of the corresponding outward projecting wall 43 of the third member 25, and is located on the side toward the heat exchange tubes 16 in relation to the projecting end surfaces of the corresponding protrusions 63 and 64 of the first and third members 23 and 25. The structure of the remaining potion is the same as that of the end member 80 shown in FIGS. 12 and 13.

When all the components are assembled so as to manufacture the evaporator 1, the end members 80 are combined with the first, second, and third members 23, 24, and 25 of the tank main body 21 as follows. Namely, the engagement claws 90 each composed of the first portion 91 which extends straight and outward in the front-rear direction and the second portion 92 which extends from the distal end of the first portion 91 toward the longitudinal center of the tank main body 21 are provided on each end member 80 (see FIG. 15). Subsequently, the caps 81 and 82 of the left and right end members 80 are fitted into the opposite ends of the tubular bodies 48 and 49 of the tank main body 21, and the first portion 91 of each engagement claw 90 is bent at an intermediate position in the longitudinal direction so as to bring the bent portion into close contact with the outer surface of the corresponding protrusion 63 of the first member 23, and bring the second portion 92 into close contact with the surfaces of the corresponding protrusions 63 and 64, which surfaces face toward the longitudinal center of the tank main body 21. With this operation, the second portion 92 is caused to come into engagement with the corresponding protrusion 63 of the first member 23, and the distal end portion of the second portion 92 is caused to enter the gap between the corresponding protrusions 63 and 64 of the first and third members 23 and 25 and the left or right end of the corresponding outward projecting wall 43 of the third member 25, and is located inward (in the front-rear direction) in relation to the outer surface of the corresponding protrusion 63 of the first member 23, the outer surface being located on the outer side with respect to the front-rear direction. In this manner, the first, second, and third members 23, 24, and 25 are provisionally fixed together, and the end members 80 are provisionally fixed to the first, second, and third members 23, 24, and 25.

Figure 16:
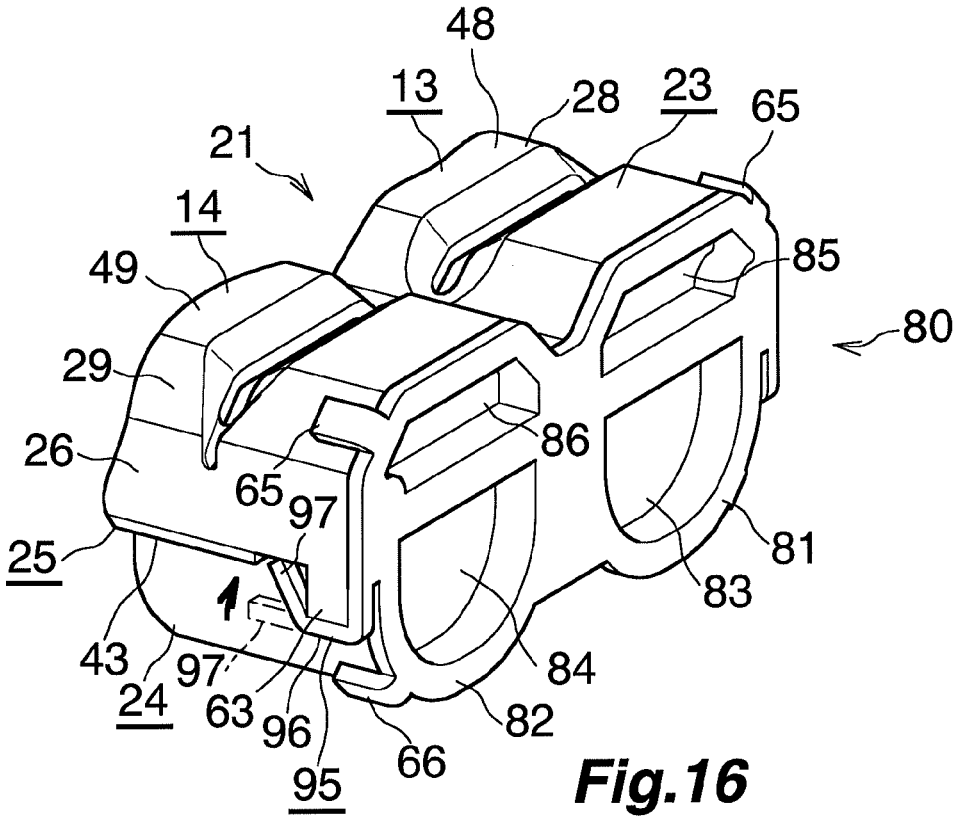
FIG. 16 is a perspective view of a right portion of the second header tank which shows a third modification of the end member.

In the modification shown in FIG. 16, each of engagement claws 95 provided on the caps 81 and 82 of each end member 80 and engaged with the protrusions 63 and 64 of the first and third members 23 and 25 has a first portion 96 and a second portion 97. The first portion 96 is caused to extend along the projecting end surfaces (outer surfaces as viewed in the vertical direction) of the corresponding protrusions 63 and 64 of the first and third members 23 and 25, and are brazed to the protrusions 63 and 64. The second portion 97 extends from the distal end of the first portion 96, is bent inward in the vertical direction (toward the heat exchange tubes 16) such that the second portion 97 comes into engagement with the corresponding protrusion 63 of the first member 23, and the distal end portion of the second portion 97 is located on the side toward the heat exchange tubes 16 in relation to the projecting end surfaces of the corresponding protrusions 63 and 64 of the first and third members 23 and 25. The second portion 97 of the engagement claw 95 inclines toward the heat exchange tubes 16. The inclination starts from the proximal end on the side toward the first portion 96, and continues up to the distal end of the second portion 97. Thus, the distal end portion of the second portion 97 enters the gap between the corresponding protrusions 63 and 64 of the first and third members 23 and 25 and the left or right end of the corresponding outward projecting wall 43 of the third member 25.

When all the components are assembled so as to manufacture the evaporator 1, the end members 80 are combined with the first, second, and third members 23, 24, and 25 of the tank main body 21 as follows. Namely, the second portion 97 of each engagement claw 95 of each end member 80 is formed to extend straight from the first portion 96 (see a chain line in FIG. 16). Subsequently, the caps 81 and 82 of the left and right end members 80 are fitted into the opposite ends of the tubular bodies 48 and 49 of the tank main body 21, and the second portion 97 of each engagement claw 95 is bent such that the second portion 97 comes into engagement with the corresponding protrusion 63 of the first member 23. Thus, the second portion 97 is caused to incline toward the heat exchange tubes 16 such that the inclination starts from the proximal end on the side toward the first portion 96, and continues up to the distal end of the second portion 97. With this operation, the distal end portion of the second portion 97 is caused to enter the gap between the corresponding protrusions 63 and 64 of the first and third members 23 and 25 and the left or right end of the corresponding outward projecting wall 43 of the third member 25, and is located on the side toward the heat exchange tubes 16 in relation to the surface of the corresponding protrusion 63 of the first member 23, the surface being located on the side opposite the heat exchange tubes 16. In this manner, the first, second, and third members 23, 24, and 25 are provisionally fixed together, and the end members 80 are provisionally fixed to the first, second, and third members 23, 24, and 25.

Figure 17:
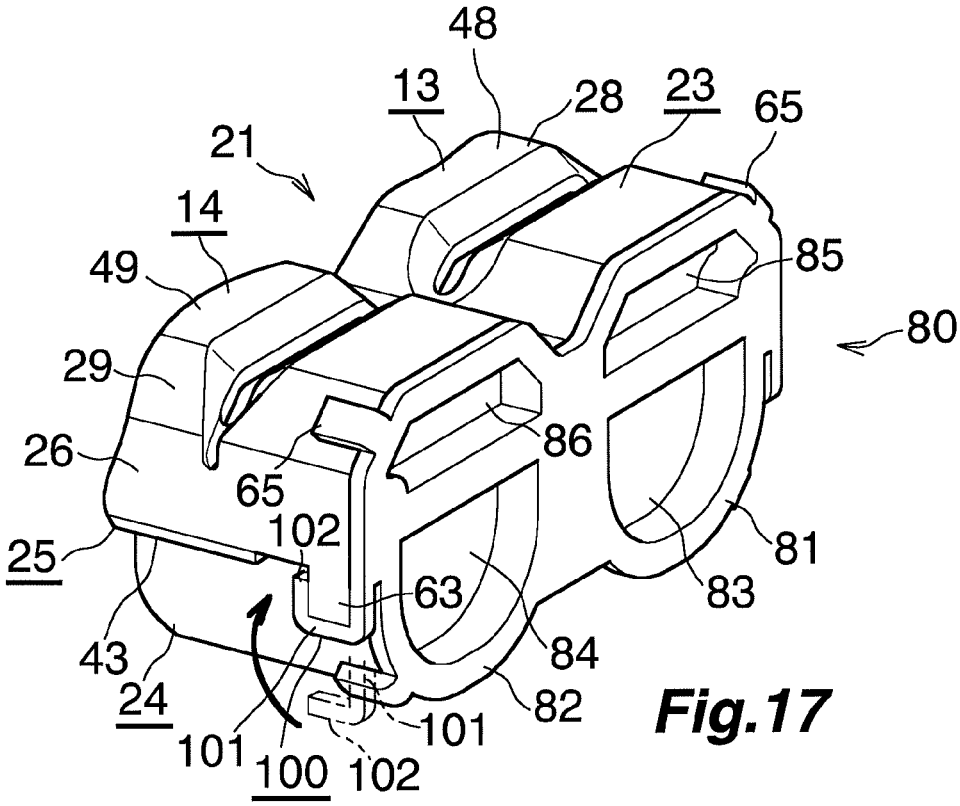
FIG. 17 is a perspective view of a right portion of the second header tank which shows a fourth modification of the end member.

In the modification shown in FIG. 17, each of engagement claws 100 provided on the caps 81 and 82 of each end member 80 and engaged with the protrusions 63 and 64 of the first and third members 23 and 25 has a first portion 101 and a second portion 102. The first portion 101 is caused to extend along the projecting end surfaces of the corresponding protrusions 63 and 64 of the first and third members 23 and 25, and is brazed to the protrusions 63 and 64. The second portion 102 extends from the distal end of the first portion 101, and is bent toward the heat exchange tubes 16 such that the second portion 102 extends along the surfaces of the protrusions 63 and 64 of the first and third members 23 and 25, the surfaces facing toward the longitudinal center of the tank main body 21. The second portion 102 is brazed to the protrusions 63 and 64. The distal end portion of the second portion 102 enters the gap between the corresponding protrusions 63 and 64 of the first and third members 23 and 25 and the left or right end of the corresponding outward projecting wall 43 of the third member 25, and is located on the side toward the heat exchange tubes 16 in relation to the projecting end surfaces of the corresponding protrusions 63 and 64 of the first and third members 23 and 25. The structure of the remaining potion is the same as that of the end member 80 shown in FIG. 16.

When all the components are assembled so as to manufacture the evaporator 1, the end members 80 are combined with the first, second, and third members 23, 24, and 25 of the tank main body 21 as follows. Namely, the engagement claws 100 each composed of the first portion 101 which extends straight toward the side opposite the heat exchange tubes 16 and the second portion 102 which extends from the distal end of the first portion 101 toward the longitudinal center of the tank main body 21 are provided on each end member 80. Subsequently, the caps 81 and 82 of the left and right end members 80 are fitted into the opposite ends of the tubular bodies 48 and 49 of the tank main body 21, and the first portion 101 of each engagement claw 100 is bent at an intermediate position in the longitudinal direction so as to bring the bent portion into close contact with the projecting end surfaces of the corresponding protrusions 63 and 64 of the first and third members 23 and 25, and bring the second portion 102 into close contact with the surfaces of the corresponding protrusions 63 and 64 of the first and third members 23 and 25, which surfaces face toward the longitudinal center of the tank main body 21. With this operation, the distal end portion of the second portion 102 is caused to enter the gap between the corresponding protrusions 63 and 64 of the first and third members 23 and 25 and the left or right end of the corresponding outward projecting wall 43 of the third member 25, and is located on the side toward the heat exchange tubes 16 in relation to the surface of the corresponding protrusion 63 of the first member 23, the surface being located on the side opposite the heat exchange tubes 16. In this manner, the first, second, and third members 23, 24, and 25 are provisionally fixed together, and the end members 80 are provisionally fixed to the first, second, and third members 23, 24, and 25.

The end members 80 shown in FIGS. 12 to 17 may be combined with the first and third members 23 and 25 shown in FIGS. 10 and 11. Also, the engagement claws 90, 95, and 100 of the end members 80 shown in FIGS. 14 to 17 may be applied to the end member 22 shown in FIG. 9.

In the above-described embodiment, the entirety of the leeward upper header section of the first header tank serves as a refrigerant inlet header section, the entirety of the windward upper header section of the first header tank serves as a refrigerant outlet header section, the entirety of the leeward lower header section of the second header tank serves as a first intermediate header section, and the entirety of the windward lower header section of the second header tank serves as a second intermediate header section. However, the present invention is not limited to such a structure. For example, the structure may be modified such that the interior of the leeward upper header section of the first header tank is divided into a plurality of sections arranged in the longitudinal direction of the first header tank, the section at either of the opposite ends serves as a refrigerant inlet header section, the interior of the windward upper header section of the first header tank is divided into a plurality of sections arranged in the longitudinal direction of the first header tank, and the section at either of the opposite ends serves as a refrigerant outlet header section.

What is claimed is:

1. A heat exchanger comprising a heat exchange core section which includes a plurality of heat exchange tubes disposed such that their longitudinal direction coincides with a vertical direction, and header tanks which are disposed on the upper and lower sides of the heat exchange core section such that their longitudinal direction coincides with an arrangement direction of the heat exchange tubes, each header tank being composed of a tank main body whose opposite ends are open and end members brazed to the opposite ends of the tank main body so as to close openings at the opposite ends, the tank main body of each header tank being composed of a first member which forms a portion of the tank main body on the side toward the heat exchange core section and to which the heat exchange tubes are connected, a second member which forms the remaining portion of the tank main body, and a third member which is disposed between the first member and the second member and is brazed to these members and which has a partition portion for vertically dividing the interior of the header tank into two spaces, the first member and the second member having, at each of front and rear side edges thereof, vertical wall portions which partially overlap each other as viewed from the front side and which are provided such that each vertical wall portion of the second member is located on the inner side of the corresponding vertical wall portion of the first member with a gap formed therebetween, the third member having, at each of the front and rear side edges thereof, a vertical wall portion which is disposed in the gap between the corresponding vertical wall portions of the first and second members and is brazed to the vertical wall portions, and a horizontal wall portion which is provided at the distal end of the vertical portion and projects outward in the front-rear direction and to which the distal end of the corresponding vertical wall portion of the first member is brazed, and each of the end members of each header tank having engagement claws which project toward the center of the header tank with respect to the longitudinal direction thereof and which are brazed to the tank main body in a state in which the engagement claws are engaged with the tank main body, wherein a protrusion is provided at each of longitudinal opposite ends of each vertical wall portion of the first member of the tank main body of each header tank such that the protrusion extends straight from the vertical wall portion outward in the vertical direction, longitudinal opposite end portions of each horizontal wall portion of the third member of the tank main body are cut away, and the third member is provided with a protrusion which is provided at each of longitudinal opposite ends of each vertical wall portion of the third member, which is overlappingly located on the inner side of the corresponding protrusion of the first member, and which is brazed to the corresponding protrusion; and each of the engagement claws of the end members of each header tank has a first portion which extends along an outer surface of the corresponding protrusion of the first member, the outer surface being located on the outer side in the front-rear direction, and which is brazed to the corresponding protrusion, and a second portion which extends from the distal end of the first portion and is bent inward in the front-rear direction such that the second portion comes into engagement with the corresponding protrusion of the first member, and a distal end portion of the second portion is located inward in the front-rear direction in relation to the outer surface of the corresponding protrusion of the first member.

2. A heat exchanger according to claim 1, wherein the second portion of each engagement claw of the end members of each header tank inclines inward in the front-rear direction such that the inclination starts from the proximal end of the second portion on the side toward the first portion and continues up to the distal end of the second portion.

3. A heat exchanger according to claim 1, wherein the second portion of each engagement claw of the end members of each header tank extends along surfaces of the corresponding protrusions of the first and third members, the surfaces facing toward the center of the header tank with respect to the longitudinal direction thereof, and is brazed to the corresponding protrusions.

* * * * *